US009584886B2

(12) United States Patent
Lee

(10) Patent No.: US 9,584,886 B2
(45) Date of Patent: Feb. 28, 2017

(54) MICRO-SPEAKER

(71) Applicant: HTC Corporation, Taoyuan County (TW)

(72) Inventor: Yu-Sheng Lee, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 102 days.

(21) Appl. No.: 14/332,393

(22) Filed: Jul. 16, 2014

(65) Prior Publication Data

US 2016/0021443 A1 Jan. 21, 2016

(51) Int. Cl.
*H04R 1/02* (2006.01)

(52) U.S. Cl.
CPC ..... *H04R 1/02* (2013.01); *H04R 1/023* (2013.01); *H04R 2499/11* (2013.01)

(58) Field of Classification Search
CPC ..... H04R 9/02; H04R 9/047
USPC ..... 381/86, 398
See application file for complete search history.

(56) References Cited

U.S. PATENT DOCUMENTS 6,611,604 B1 * 8/2003 Irby ..... H04R 7/122 181/171
6,626,262 B1 * 9/2003 Chen ..... H04R 9/043 181/149
8,213,644 B2 * 7/2012 Choi ..... H04R 9/06 381/151
2005/0041830 A1 * 2/2005 Takewa ..... H04R 9/04 381/410
2007/0217647 A1 * 9/2007 Enomoto ..... H04R 9/02 381/410
2009/0052726 A1 * 2/2009 Hatanaka ..... H04R 7/125 381/431
2011/0158457 A1 6/2011 Ishizaka
2012/0106777 A1 * 5/2012 Fujimoto ..... H04R 9/043 381/413
2012/0122636 A1 * 5/2012 Shurtleff ..... A63B 21/4037 482/142
2012/0202559 A1 * 8/2012 Shiogama ..... H04M 1/035 455/550.1
2012/0237076 A1 * 9/2012 Kuze ..... H04R 7/20 381/387
2013/0062710 A1 * 3/2013 Dehe ..... G01L 9/0016 257/415
2013/0279735 A1 * 10/2013 Chu ..... H04R 1/00 381/398

FOREIGN PATENT DOCUMENTS

CN 202077175 U * 12/2011
TW M379297 4/2010

OTHER PUBLICATIONS

"Office Action of Taiwan Counterpart Application" , issued on Jun. 24, 2016, p. 1-p. 8.

* cited by examiner

*Primary Examiner* — Md S Elahee
*Assistant Examiner* — Julie X Dang
(74) *Attorney, Agent, or Firm* — Jianq Chyun IP Office

(57) ABSTRACT

A micro-speaker includes a speaker monomer, a housing and a waterproof membrane. The housing accommodates the speaker monomer and has an opening to output a sound generated by the speaker monomer. The waterproof membrane seals the opening and transmits the sound generated by the speaker monomer. The waterproof membrane has a center area and a peripheral area surrounding the center area, and a stiffness of the center area is greater than a stiffness of the peripheral area.

10 Claims, 5 Drawing Sheets

MICRO-SPEAKER

BACKGROUND OF THE INVENTION

Field of the Invention

The present application relates to a micro-speaker, and more particularly, relates to a micro-speaker with waterproof function.

Description of Related Art

A speaker is a device that converts an electrical signal into a sound signal. Generally, medium and large speakers are disposed independently and connected to a sound source to generate sounds. Apart from being disposed independently (e.g., headsets), small or micro speakers (hereinafter, collectively referred to as a micro-speaker) are often integrated with portable sound devices (e.g., mobile phones, smart phones, notebook computers and tablet computers) to generate a sound.

In order to prevent external dust from contacting the micro-speaker to affect performances thereof, a screen fabric is usually disposed above the micro-speaker to block external dust from entering a casing of the micro-speaker thereby reaching a diaphragm of the micro-speaker. Yet, the sound generated by the micro-speaker can still pass the screen fabric to be outputted to the outside of the casing. However, in the case when external liquid unexpectedly passes the screen fabric to enter the casing, the entered liquid cannot be exhausted outside the casing due to blockage of the screen fabric, and thus affects the performances of the micro-speaker.

To solve the problem that the screen fabric is not waterproof, currently, a conventional method is to add a waterproof membrane above the speaker to provide both waterproof and dustproof functions for the speaker. This type of waterproof membrane is usually made by forming a waterproof layer on a carrier. However, this type of waterproof membrane is usually ultra thin and prone to generation of creases which affect the performances. Accordingly, this type of waterproof membrane has higher difficulty in assembling the same.

SUMMARY OF THE INVENTION

The present application is directed to a micro-speaker having waterproof and dustproof functions.

The present application provides a micro-speaker, which includes a speaker monomer, a housing and a waterproof membrane. The housing accommodates the speaker monomer and has an opening to output a sound generated by the speaker monomer. The waterproof membrane seals the opening and transmits the sound generated by the speaker monomer. The waterproof membrane has a center area and a peripheral area surrounding the center area, and a stiffness of the center area is greater than a stiffness of the peripheral area.

Based on above, in the present application, in addition to waterproof and dustproof functions, the waterproof membrane is further divided into the center area and the peripheral area, wherein the stiffness of the center area is set to be greater than the stiffness of the peripheral area, so as to ensure the performance of the waterproof membrane in acoustical transmission.

To make the above features and advantages of the disclosure more comprehensible, several embodiments accompanied with drawings are described in detail as follows.

DETAILED DESCRIPTION OF DISCLOSED EMBODIMENTS

Figure 1:
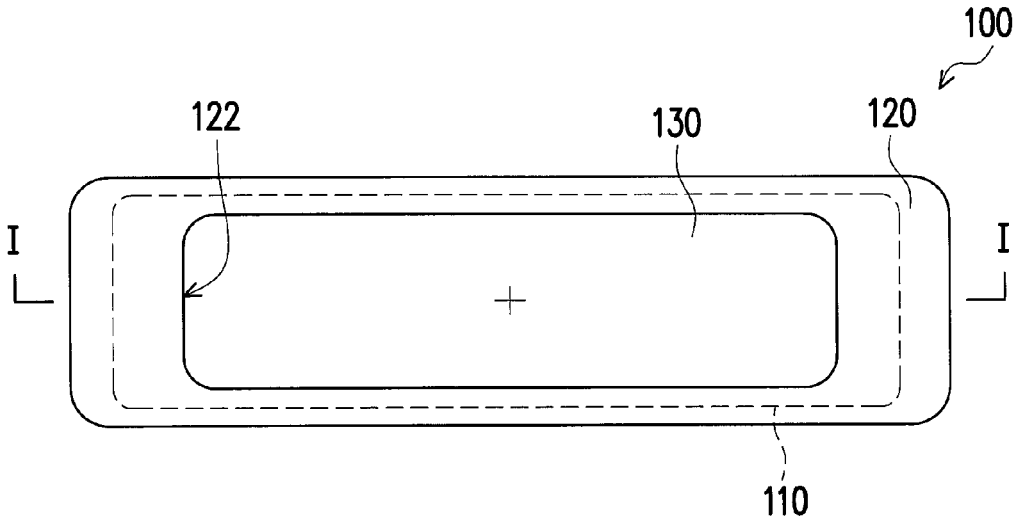
FIG. 1 is a top view of a micro-speaker according to an embodiment of the present application.
Figure 2:
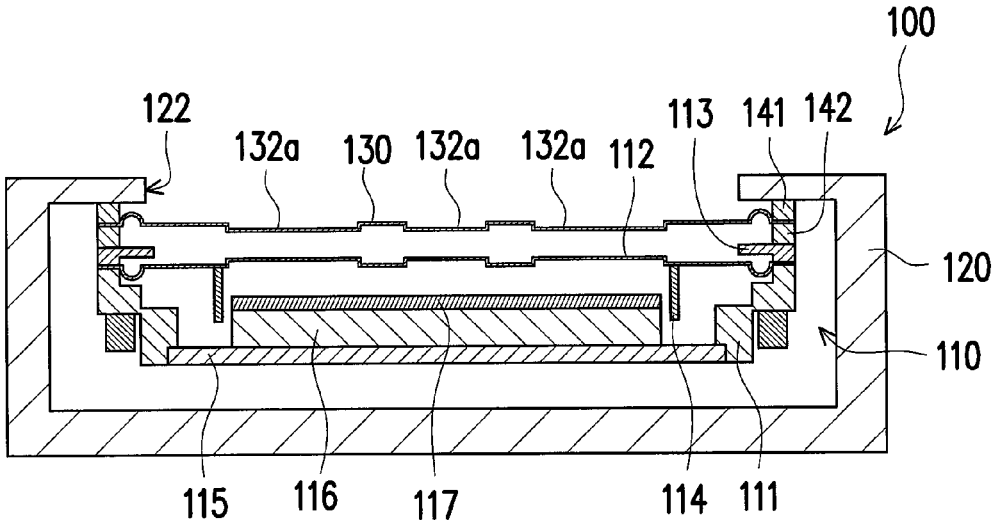
FIG. 2 is a cross-sectional view of the micro-speaker of FIG. 1 along line I-I.

FIG. 1 is a top view of a micro-speaker according to an embodiment of the present application, and FIG. 2 is a cross-sectional view of the micro-speaker of FIG. 1 along line I-I. Referring to FIG. 1 and FIG. 2, in the present embodiment, a micro-speaker 100 includes a speaker monomer 110, a housing 120 and a waterproof membrane 130. The housing 120 accommodates the speaker monomer 110 and has an opening 122 to output a sound generated by the speaker monomer 110. The waterproof membrane 130 seals the opening 122 and transmits the sound generated by the speaker monomer 110. The micro-speaker 100 further includes a first buffer member 141 and a second buffer member 142. The first buffer member 141 is disposed between the waterproof membrane 130 and the housing 120, and the second buffer member 142 is disposed between the speaker monomer 110 and the waterproof membrane 130. The first buffer member 141 also includes waterproof and dustproof functions. In the present embodiment, a material of the first buffer member 141 and the second buffer member 142 is, for example, a sponge.

In the present embodiment, the speaker monomer 110 includes a frame 111, a diaphragm 112, a front cover 113, a voice coil 114, a yoke 115, a magnet 116 and a plate 117. The front cover 113 is fixed to the frame 111, and cooperates with the frame 111 to hold the diaphragm 112. The voice coil 114 is fixed to the diaphragm 112. The yoke 115 is fixed to the frame 111. The magnet 116 is fixed to the yoke 115. The plate 117 is fixed to the magnet 116. When a high frequency current corresponding to a sound signal is applied to the voice coil 114, the voice coil 114 interacts with a magnetic field generated by the magnet 116 to move vertically, so that the diaphragm 112 fixed to the voice coil 114 vibrates to generate the sound.

Figure 3:
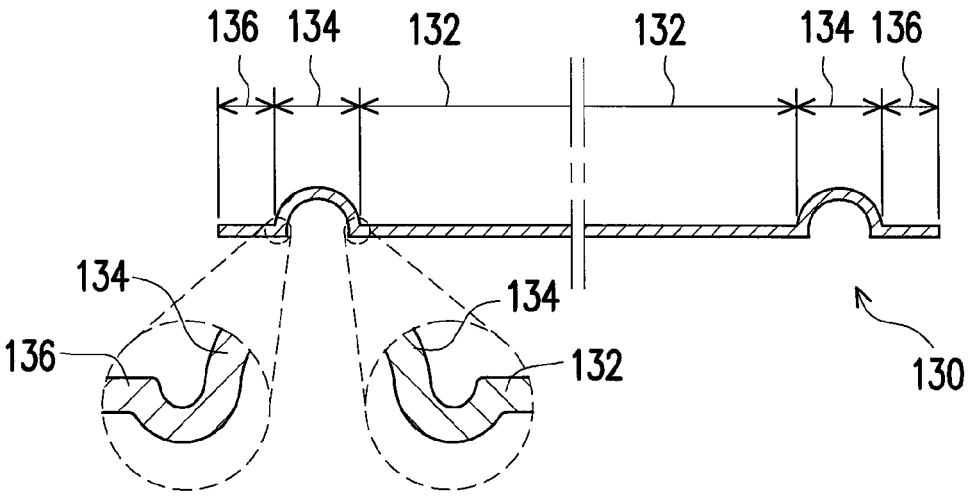
FIG. 3 is an enlarged cross-sectional view of FIG. 2, in which the center of the waterproof membrane is partially omitted.

FIG. 3 is an enlarged cross-sectional view of FIG. 2, in which the center of the waterproof membrane is partially omitted. Referring to FIG. 3, the waterproof membrane 130 has a center area 132 and a peripheral area 134 surrounding the center area 132, and a stiffness of the center area 132 is greater than a stiffness of the peripheral area 134. Definition of the stiffness refers to a ratio of an applied force and a deformation amount generated thereby, which indicates a capability of a material or a structure in resisting deformations. When the waterproof membrane 130 is made of the same material, a cross-section of the peripheral area 134 in radial direction is arc shaped, which makes the peripheral area 134 flexible. Accordingly, the stiffness of the peripheral area 134 may be reduced, such that the stiffness of the center area 132 may be greater than the stiffness of the peripheral area 134. In addition, the center area 132 of the waterproof membrane 130 may include one or more creases 132*a* (as shown in FIG. 2), which are capable of increasing the stiffness of the center area 132. In the present embodiment, a material of the waterproof membrane 130 is, for example, a macromolecular material.

Referring to FIG. 3, in the present embodiment, in order to reduce occurrences of stress concentration, a cross-section of a common border between the center area 132 and the peripheral area 134 in radial direction may be arc shaped, wherein the arc shaped cross-section of the common border is far smaller than the arc shaped cross-section of the peripheral area 134 in terms of dimension. Therefore, the common border between the center area 132 and the peripheral area 134 can be less prone to damages due to stress concentration, so as to facilitate in extending operating life. In addition, the waterproof membrane 130 further includes a fixed area 136 which surrounds the peripheral area 134. Similarly, a cross-section of a common border between the peripheral area 134 and the fixed area 136 in radial direction may also be arc shaped, so as to reduce occurrences of stress concentration.

Referring to FIG. 2 and FIG. 3, an orthographic projection of the peripheral area 134 on the housing 120 is not overlapping with the opening 122 but overlapping with a portion adjacent to the opening 122, so that the portion of the housing 120 adjacent to the opening 122 can cover the peripheral area 134.

Figure 4:
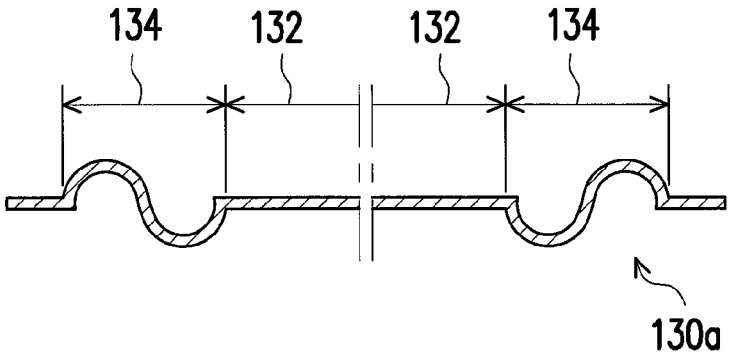
FIG. 4 is an enlarged cross-sectional view of a micro-speaker according to another embodiment of the present application, in which the center of the waterproof membrane is partially omitted.
Figure 5:
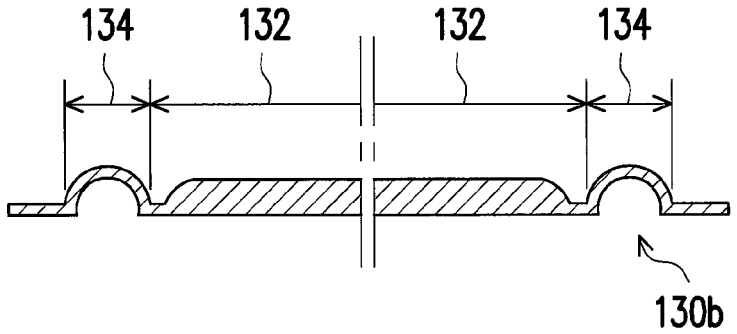
FIG. 5 is an enlarged cross-sectional view of a micro-speaker according to another embodiment of the present application, in which the center of the waterproof membrane is partially omitted.

FIG. 4 is an enlarged cross-sectional view of a micro-speaker according to another embodiment of the present application, in which the center of the waterproof membrane is partially omitted. Referring to FIG. 5, as compared to the waterproof membrane 130 of FIG. 3, in a waterproof membrane 130*a* of the present embodiment, a cross-section of the peripheral area 134 in radial direction is multiple-arc shaped (e.g., multiple-arc shaped into a S-shape), which also makes the peripheral area 134 flexible. Accordingly, the stiffness of the peripheral area 134 may be reduced, such that the stiffness of the center area 132 may be greater than the stiffness of the peripheral area 134.

FIG. 5 is an enlarged cross-sectional view of a micro-speaker according to another embodiment of the present application, in which the center of the waterproof membrane is partially omitted. Referring to FIG. 4, as compared to the waterproof membrane 130 of FIG. 3, in a waterproof membrane 130*b* of the present embodiment, a thickness of the center area 132 is set to be greater than a thickness of the peripheral area 134. Accordingly, by increasing the thickness of the center area 132, the stiffness of the center area 132 may be greater than the stiffness of the peripheral area 134. In another embodiment which is not illustrated, as compared to the waterproof membrane 130 of FIG. 3, the same effect as described above may also be achieved by reducing the thickness of the peripheral area 134.

Figure 6:
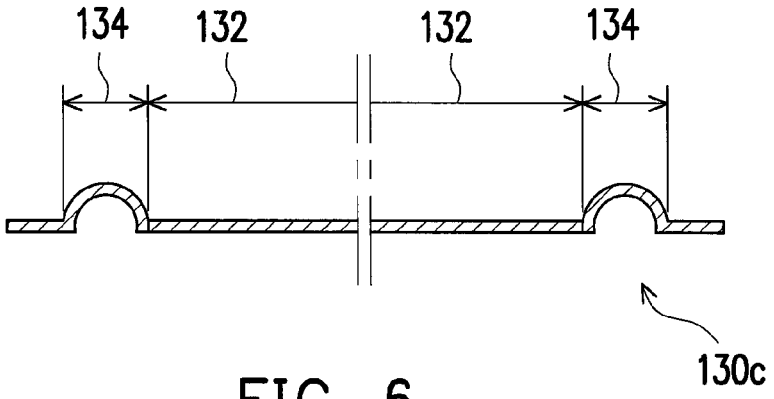
FIG. 6 is an enlarged cross-sectional view of a micro-speaker according to another embodiment of the present application, in which the center of the waterproof membrane is partially omitted.

FIG. 6 is an enlarged cross-sectional view of a micro-speaker according to another embodiment of the present application, in which the center of the waterproof membrane is partially omitted. Referring to FIG. 6, as compared to the waterproof membrane 130 of FIG. 3, in a waterproof membrane 130*c* of the present embodiment, a material of the center area 132 is different from a material of the peripheral area 134. Specifically, the material of the center area 132 may adopt materials with greater stiffness (e.g., the macromolecular material with greater stiffness), and the material of the peripheral area 134 may adopt materials with smaller stiffness (e.g., the macromolecular material with smaller stiffness), such that the stiffness of the center area 132 may be greater than the stiffness of the peripheral area 134.

Figure 7:
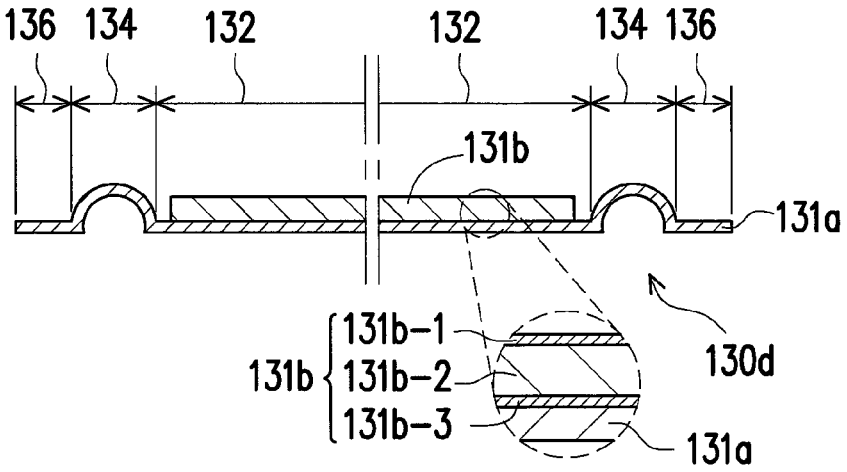
FIG. 7 is an enlarged cross-sectional view of a micro-speaker according to another embodiment of the present application, in which the center of the waterproof membrane is partially omitted.

FIG. 7 is an enlarged cross-sectional view of a micro-speaker according to another embodiment of the present application. Referring to FIG. 7, as compared to the waterproof membrane 130 of FIG. 3, in the present embodiment, a waterproof membrane 130*d* includes a foundation layer 131*a* and an adhesion layer 131*b*. The foundation layer 131*a* defines the center area 132, the peripheral area 134 and the fixed area 136, and the adhesion layer 131*b* is stacked over the center area 132 of the foundation layer 131*a*, so as to increase the stiffness of the center area 132. The adhesion layer 131*b* may be a composite material. In the present embodiment, the adhesion layer 131*b* may include two aluminum foils 131*b*-1 and a sponge layer 131*b*-2, and the sponge layer 131*b*-2 is sandwiched between the two aluminum foils 131*b*-1. Nonetheless, in another embodiment which is not illustrated, the adhesion layer 131*b* may also be one single material layer.

Figure 8:
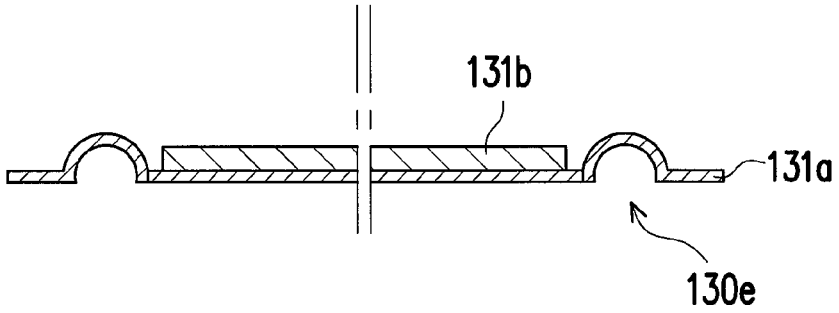
FIG. 8 is an enlarged cross-sectional view of a micro-speaker according to another embodiment of the present application, in which the center of the waterproof membrane is partially omitted.

FIG. 8 is an enlarged cross-sectional view of a micro-speaker according to another embodiment of the present application. Referring to FIG. 8, in the present embodiment, a waterproof membrane 130*e* may be obtained by combining the waterproof membrane 130*c* of FIG. 6 as the foundation layer 131*a* together with the adhesion layer 131*b* of FIG. 7.

Figure 9A:
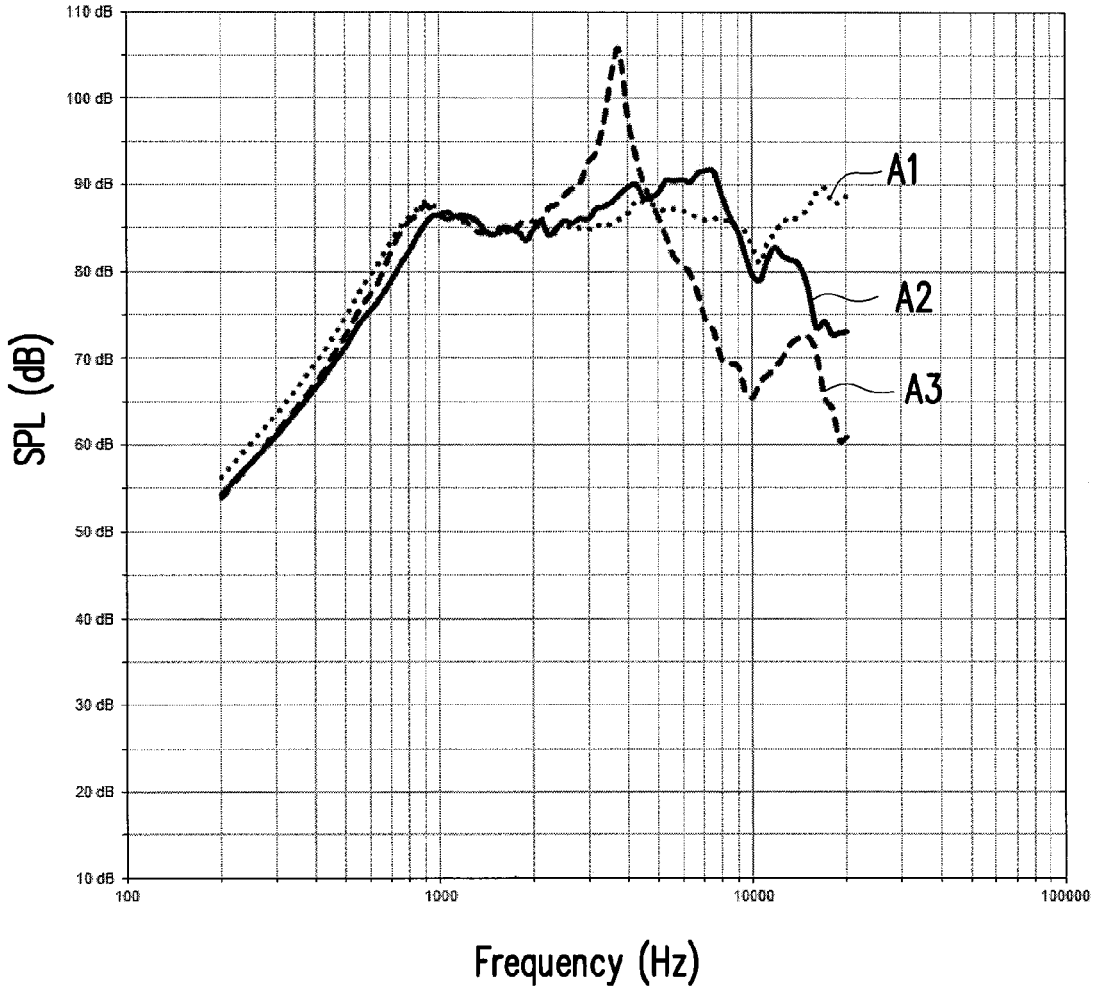
FIG. 9A illustrates a comparison among sound pressure levels (SPL) of the micro-speakers without the waterproof membrane, with the conventional waterproof membrane, and with the waterproof membrane of the present application, under different frequencies.
Figure 9B:
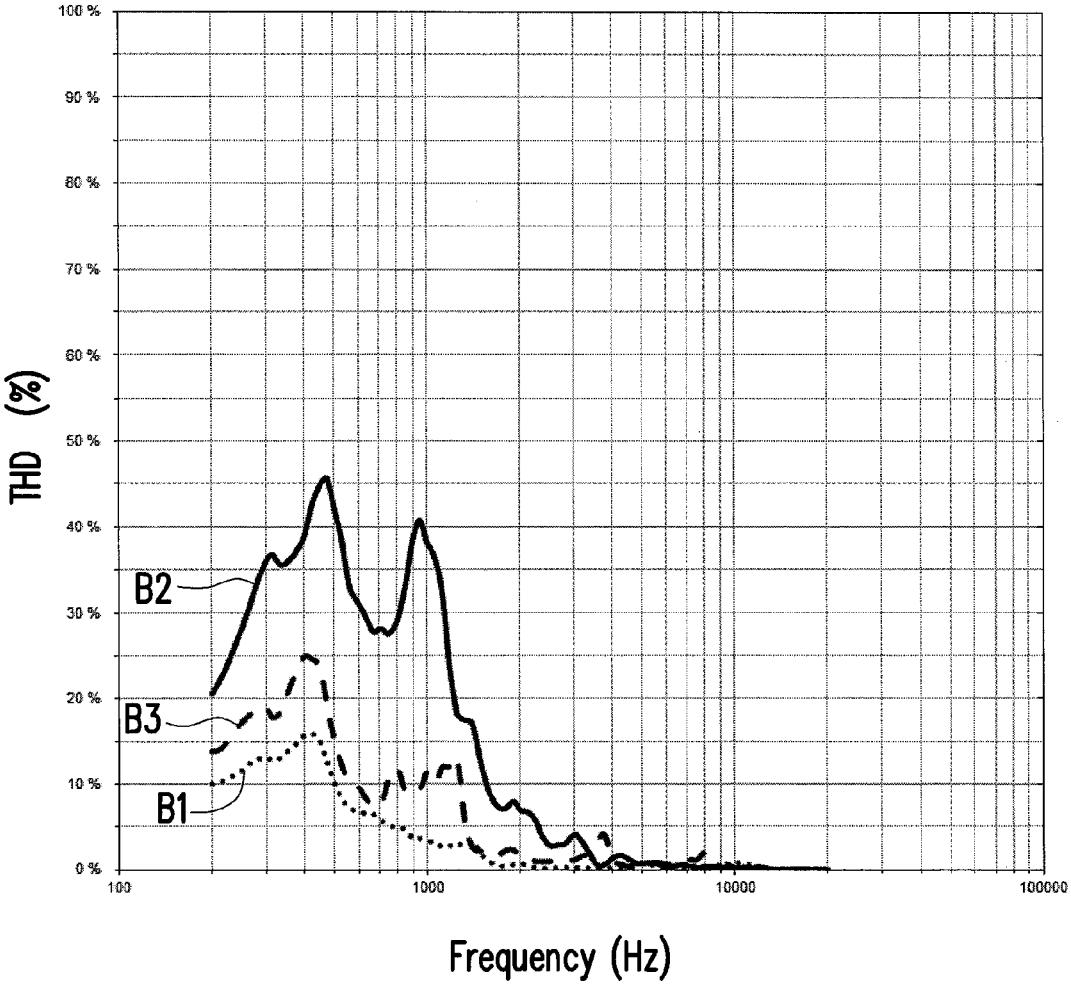
FIG. 9B illustrates a comparison among total harmonic distortions (THD) of the micro-speakers without the waterproof membrane, with the conventional waterproof membrane, and with the waterproof membrane of the present application, under different frequencies.

FIG. 9A illustrates a comparison among sound pressure levels (SPL) of the micro-speakers without the waterproof membrane, with the conventional waterproof membrane, and with the waterproof membrane of the present application, under different frequencies. In view of FIG. 9A which takes the micro-speaker of FIG. 2 (in which the waterproof membrane of the present application is not included) as the same simulated environment, it can be known that a SPL curve A3 of the micro-speaker with the waterproof membrane of the present application has more stable SPL outputs, as compared to a SPL curve A1 of the micro-speaker without the waterproof membrane and a SPL curve A2 of the micro-speaker with the conventional waterproof membrane. In addition, FIG. 9B illustrates a comparison among total harmonic distortions (THD) of the micro-speakers without the waterproof membrane, with the conventional waterproof membrane, and with the waterproof membrane of the present application, under different frequencies. In view of FIG. 9A which also takes the micro-speaker of FIG. 2 (in which the waterproof membrane of the present application is not included) as the same simulated environment, it can be known that a THD curve B3 of the micro-speaker with the waterproof membrane of the present application has lower percent distortion, as compared to a THD curve B1 of the micro-speaker without the waterproof membrane and a THD curve B2 of the micro-speaker with the conventional waterproof membrane.

In summary, in the micro-speaker of the present application, in addition to waterproof and dustproof functions, the waterproof membrane is further divided into the center area and the peripheral area, wherein the stiffness of the center area is set to be greater than the stiffness of the peripheral area, so as to ensure the performance of the waterproof membrane in acoustical transmission. Moreover, in the foregoing embodiments, variations of stiffnesses of the center area and the peripheral area may be made by changing the shapes, the thicknesses and the materials of the center area and the peripheral area of the waterproof membrane. Accordingly, in comparison with existing waterproof membrane that is ultra thin and hard to assemble, the thickness of the waterproof membrane of the present application may be increased to lower the difficulty in assembling the same.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A micro-speaker, comprising:

a speaker monomer;

a housing, accommodating the speaker monomer and having an opening to output a sound generated by the speaker monomer; and a waterproof membrane, sealing the opening and transmitting the sound generated by the speaker monomer, wherein the waterproof membrane has a center area and a peripheral area surrounding the center area, and a stiffness of the center area is greater than a stiffness of the peripheral area wherein the waterproof membrane comprises a foundation layer and an adhesion layer, the foundation layer defines the center layer and the peripheral area, and the adhesion layer is stacked over the center area of the foundation layer, wherein the adhesion layer comprises two aluminum foils and a sponge layer, and the sponge layer is sandwiched between the two aluminum foils, wherein the waterproof membrane comprises a foundation layer and an adhesion layer, the foundation layer defines the center layer and the peripheral area, and the adhesion layer is stacked over the center area of the foundation layer, wherein the adhesion layer comprises two aluminum foils and a sponge layer, and the sponge layer is sandwiched between the two aluminum foils.

2. The micro-speaker of claim 1, further comprising:

a first buffer member, disposed between the waterproof membrane and the housing; and a second buffer member, disposed between the speaker monomer and the waterproof membrane.

3. The micro-speaker of claim 1, wherein an orthographic projection of the peripheral area on the housing is not overlapping with the opening.

4. The micro-speaker of claim 1, wherein the speaker monomer comprises:

a frame;

a diaphragm;

a front cover, fixed to the frame, and cooperating with the frame to hold the diaphragm;

a voice coil, fixed to the diaphragm;

a yoke, fixed to the frame;

a magnet, fixed to the yoke; and a plate, fixed to the magnet.

5. The micro-speaker of claim 1, wherein a cross-section of the peripheral area in radial direction is arc shaped.

6. The micro-speaker of claim 1, wherein a cross-section of the peripheral area in radial direction is multiple-arc shaped.

7. The micro-speaker of claim 1, wherein a cross-section of a common border between the center area and the peripheral area in radial direction is arc shaped.

8. The micro-speaker of claim 1, wherein a thickness of the center area is greater than a thickness of the peripheral area.

9. The micro-speaker of claim 1, wherein the center area has at least one crease.

10. The micro-speaker of claim 1, wherein a material of the center area is different from a material of the peripheral area.

* * * * *